US008136738B1

(12) United States Patent
Kopp

(10) Patent No.: US 8,136,738 B1
(45) Date of Patent: Mar. 20, 2012

(54) CONTROL SYSTEM FOR ELECTRICAL APPLIANCES

(75) Inventor: Phillip Kopp, San Diego, CA (US)

(73) Assignee: Energy Eye, Inc., Poway, CA (US)

( * ) Notice: Subject to any disclaimer, the term of this patent is extended or adjusted under 35 U.S.C. 154(b) by 64 days.

(21) Appl. No.: 12/229,391

(22) Filed: Aug. 22, 2008

Related U.S. Application Data

(63) Continuation of application No. 11/116,936, filed on Apr. 27, 2005, now abandoned.

(60) Provisional application No. 60/566,229, filed on Apr. 27, 2004.

(51) Int. Cl.
*G05D 23/00* (2006.01)
*F25B 49/00* (2006.01)
*F24F 11/00* (2006.01)

(52) U.S. Cl. ..... 236/51; 62/131; 165/237

(58) Field of Classification Search ..... 236/51; 165/11.1, 11.2, 237; 62/131
See application file for complete search history.

(56) References Cited

U.S. PATENT DOCUMENTS

| | | | | |
|---|---|---|---|---|
| 4,433,809 | A * | 2/1984 | Schulz | 236/47 |
| 5,476,221 | A * | 12/1995 | Seymour | 236/47 |
| 5,861,806 | A * | 1/1999 | Vories et al. | 340/555 |
| 6,196,468 | B1 * | 3/2001 | Young | 236/46 R |
| 6,791,458 | B2 * | 9/2004 | Baldwin | 340/522 |
| 7,058,477 | B1 * | 6/2006 | Rosen | 700/277 |

* cited by examiner

*Primary Examiner* — Marc Norman
(74) *Attorney, Agent, or Firm* — Procopio, Cory, Hargreaves & Savitach LLP; Neol C. Gillespie; Patrick J. Lavender

(57) ABSTRACT

A control system for electrical appliances associated with an enclosure comprising a wireless occupancy sensor for monitoring the presence of a human occupant within the enclosure, a wireless receiver for receiving information from the sensor, electricity flow means capable of establishing or interrupting the flow of electricity to an electrical appliance associated with the enclosure in response to a signal from a controller, and a controller in communication with said receiver and said electricity flow means, the controller capable of monitoring environmental conditions in the enclosure and being programmable to drive the operation of the flow means in response to the information obtained by the receiver from the sensor according to a set of pre-established instructions.

15 Claims, 5 Drawing Sheets

CONTROL SYSTEM FOR ELECTRICAL APPLIANCES

RELATED APPLICATIONS INFORMATION

This application is a continuation application of U.S. patent application Ser. No. 11/116,936, filed on Apr. 27, 2005, now abandoned which is a non-provisional of U.S. Provisional Application No. 60/566,229, filed on Apr. 27, 2004, now abandoned all of which are incorporated herein by reference in their entirety as if set forth in full.

FIELD OF THE INVENTION

The present invention relates generally to the control of electrical appliances and, more particularly, to the reduction of energy consumption in electrical appliances such as institutional lighting and HVAC systems.

BACKGROUND OF THE INVENTION

Any type of current-drawing appliance is a consumer of electricity. There are several different sources of electricity in the world. Some sources are natural, such as lightning, some are a combination of nature and human efforts, such as wind farming, and some are completely man made, such as coal-fueled power generation. All however have one commonality: A limit to production and supply.

It was once thought that the use of nuclear reactions and high pressure steam generation, in conjunction with high efficiency turbines, would generate unlimited amounts of electricity to be used in society. After several mishaps, and the realization that the disposal of nuclear waste remains problematic, it became clear that nuclear power generation would not be a panacea. Alternate energy sources have been developed, such as harnessing wind power, damming rivers and tidal generation, to help supplement electricity generation. These sources however rely on nature, and have limited capability in their power. They simply do not produce enough power at this stage of development to sustain current electricity demands.

The current choice for power production is to use unclean sources such as coal or oil burning production. This is the most widely used source for electricity generation, however it is also the dirtiest. The atmosphere is continually polluted through the burning of these fuels to produce electricity. The current scheme also uses up natural resources of a limited supply. As these resources become more and more scarce, their cost rises, and increases the cost to use these fuels as sources of electricity production. The final result is a spiraling upward of the cost to produce electricity. Concurrently, as society develops, it becomes more and more reliant on the use of electricity in everyday lives. Electricity is used to run appliances and machinery, to run manufacturing facilities and power homes and offices. Thus society faces the daunting situation where feasible energy production is decreasing and demand is increasing exponentially.

The remaining option is to reduce electricity consumption. It has been proven that the cheapest and easiest way to produce electricity cheaply is actually to not use it at all! That is because most of the appliances used in society are wasteful of their electricity supply. Many such appliances were engineered with a seemingly limitless supply of energy in mind. It is however, very feasible to approach these appliances with another perspective, to aid them in their use of energy and electricity and to improve their efficiency. By doing so the amount of wasted electricity is reduced, as well as the demands for additional production. Only recently has this become a popular notion as the operating cost of business rises with the cost of resources. Because it is costing more to live today because of an increase in the cost of energy, business and industry are starting to pay attention to the problem at hand. The truth is that business wants to reduce their operating cost and they are starting to see energy as a major sieve in their expenses.

Thus, it is considered desirable to provide control systems which can be configured to reduce the amount of electricity consumed by electrical appliances when such consumption is not necessary for health and welfare.

DISCLOSURE OF THE INVENTION

The present invention provides a control system for electrical appliances, and in particular, a control system to reduce consumption of electricity when the appliances can be shut down during periods of unnecessary use, without affecting their operation during periods of actual use.

In one aspect, the present invention provides a control system for electrical appliances associated with an enclosure comprising at least one wireless occupancy sensor for monitoring the presence of a human occupant within the sensor's field of evaluation in the enclosure, the sensor capable of transmitting uniquely-encoded information to a receiver; at least one wireless receiver configured for the reception of uniquely-encoded information from the sensor; at least one electricity flow means capable of establishing or interrupting the flow of electricity to an electrical appliance associated with the enclosure in response to a signal from a controller; and at least one controller in communication with the receiver and the electricity flow means, the controller capable of monitoring environmental conditions in the enclosure and being programmable to drive the operation of said flow means in response to the information obtained by the receiver from the sensor according to a set of pre-established instructions.

DETAILED DESCRIPTION OF THE INVENTION

Figure 1:
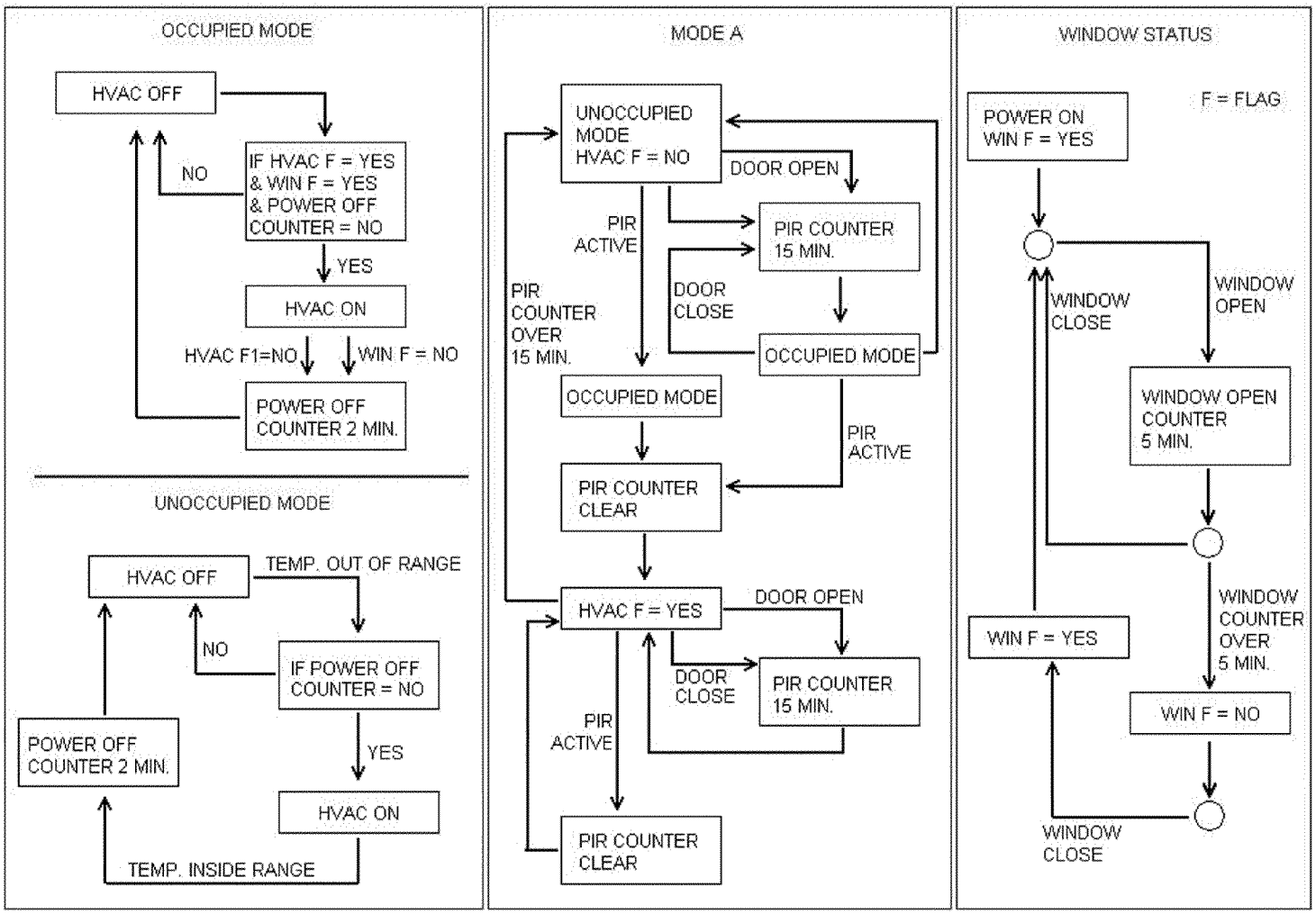
FIG. 1 is a block diagram depicting one embodiment of a mode of operation of the present system.

The present invention provides a control system for electrical appliances, and in particular, a control system to reduce consumption of electricity when the appliances can be shut down during periods of unnecessary use, without affecting their operation during periods of actual use.

In one aspect, the present invention provides a control system for electrical appliances associated with an enclosure comprising at least one wireless occupancy sensor for monitoring the presence of a human occupant within the sensor's field of evaluation in the enclosure, the sensor capable of transmitting uniquely-encoded information to a receiver; at least one wireless receiver configured for the reception of uniquely-encoded information from the sensor; at least one electricity flow means capable of establishing or interrupting the flow of electricity to an electrical appliance associated with the enclosure in response to a signal from a controller; and at least one controller in communication with the receiver and the electricity flow means, the controller capable of monitoring environmental conditions in the enclosure and being programmable to drive the operation of said flow means in response to the information obtained by the receiver from the sensor according to a set of pre-established instructions.

General Considerations

Through research it has been proven that one of the most effective ways to reduce the consumption of electricity by an appliance is simply by turning the appliance off. This phenomenon is defined by the term "ghost load." A ghost load is any electrical appliance that is consuming energy while not being used. An example could be a light bulb that was left on when you leave the house for dinner or a copy machine left on overnight in the office. It can even be as finite as a television that is plugged in, on standby and not turned on, as its circuitry is still using a small amount of electricity simply by being plugged into the source. Of course, "used" is taken in here in the sense of whether such use is necessary for the safety or comfort of the occupant. An HVAC system or light bulb is being "used" in the broadest sense, by adjusting temperature or lighting an enclosure, without regard to the presence of an occupant. However, such "use" is not deemed necessary when the occupant is absent.

Because human beings are not ordinarily mindful of the energy used in daily life, such electric consumption is not often considered and care is not exercised in managing these appliances. By turning them off when not in use, consumption can be reduced and therefore the demand for energy production can be eased.

This leads to the concept of automation, the core concept of the present invention. By automating the control of electrical appliances, it is possible to reduce the consumption of electricity when an electrical appliance is not in use, and thus reduce or eliminate the "ghost load" of wasted electrical energy. Since every electrical appliance must be connected to the power source somehow there is always a point between where the energy is supplied and where it is drawn from. In larger applications such as a commercial building there is wiring throughout the building that is tied into the lighting systems and climate control systems. Small appliances are connected with plugs that allow them to be easily removed. Due to the nature of electricity, it is easy to start or stop its flow. It simply requires the disconnection of the source from the consumption. This electricity flow control can be performed, for example, by a device that is proven and effective: A relay.

System Components

A relay is affordable and effective for the purpose of electricity flow control. It is placed between the source and the consumer. It is energized with electricity itself so that when it is un-energized a mechanical switch releases and the flow of electricity is stopped. When it is re-energized the switch returns and once again allows the flow of energy. A relay can be placed in-line with any electricity-consuming appliance to start and stop the flow of electricity to that appliance.

The relay is a common device, but it requires something to instruct it when to open and close the flow of electricity. This is the goal of the present control system. The present system will instruct the relay when to allow or restrict the flow of electricity to any electrical appliance by being able to understand whether the enclosure space that the appliance is located in (or affects) is occupied by a human user. The concept is simple: if a potential user occupies the area, the relay will allow the flow of electricity to that appliance. If the area is determined to be unoccupied, an instruction is sent to the relay to discontinue the flow of electricity, thereby turning off that appliance. This is a general theory and is currently being developed and widely used for many applications.

The present control system will determine the occupancy of a human user in the appliance enclosure space. Again there is a well-established platform of technology that can be reliably used to detect humans in this space. The technology is called Passive Infrared (PIR) sensing. PIR sensing technology has been used and developed to detect movements over several decades. The technology uses infrared spectrum changes in a defined space to determine that an object is in fact moving. When the detector sees the change in infrared spectrum, the circuitry can determine that something is moving in its evaluation space. These detectors have become increasingly more sophisticated to employ heat detection as well as spectrum division in order to distinguish between the movement of an inanimate object, such as a rock falling or the movement of a small pet on the ground, and finally the movement of a human being (which is generally taller than 3 feet and can occupy multiple divisions). Therefore this sensing technology can be adapted to accurately determine that in fact a human user occupies an appliance's enclosure area. By combining those two simple technologies, and tying them together with a simple control processor, the present control system can determine if a human user is present in a defined space and drive the relay to activate or de-activate power to a given appliance.

The present invention is stated in very general terms and has an extremely broad range of potential application. This could be used with any electricity-consuming appliance in any environment within the viewing range of the PIR sensor. Its application is literally infinite and to list the compatible appliances or spaces would be incredibly tedious. However, there are certain primary applications in which the present control system could have the most practical application and profound effect.

Some of these applications will also require the use of a third component, which is again widely used and proven in its ability to operate. This component is called the Magnetic Reed Sensor (MR). The MR is a small electric reed element that is magnetized so that if a ferrous magnetic source is applied or removed from the element it can detect the change in magnetic field and supply that information to a receiver.

Its primary application is to tell whether a door or a window has been opened or closed. In any enclosure intended for human occupancy, there is typically some type of entrance door or window, to allow access to the enclosed space. In applications of the present control system where there is an indoor space with a door, it can be important to be able to understand that that door is opened or closed. Such information will help to increase the accuracy of the occupancy determination, because it can be known that a human user has entered or left the enclosure space. The information can also permit the control of certain appliances in a more efficient manner that may be affected by the outside elements. For example, a climate control system in a building will not be as effective if all the windows are opened; the system may strain to maintain an internal temperature that is not possible with an escape for the internal environment. By understanding that the doors or windows are open, the system can be controlled in a more efficient manner by simply driving the relay to remove power from the climate system if the windows are opened. This will encourage the user to close the windows or may prevent other external factors that are hazardous to the system or its human users, such as humidity, rain or snow, from entering the enclosure space.

In other applications there can be an unlimited number of sensors to help input the necessary information for the present control system to determine if an appliance is desirably turned on or off. These sensors could detect any number of criteria and again the list would be extensive. In the broadest terms, the present control system will be able to accept an input from an external sensor of any type that may be used to instruct it to turn an appliance on or off.

In the present control system, all of the sensors and relays are tied together with a central processor or controller. The central processor is the "brain" of the present control system and it accepts the input signals. It should be able to recognize multiple inputs from multiple sensors and should be able to process them all through a central logic device that can be programmed through software as to the proper recognition of the sensor inputs, how to translate them, and finally what output will be appropriate for the various relays that are operated to turn on and off appliances. This "Brain" will be the point that ties together every element that comprises the present system. It will contain inputs for the sensors, and outputs for the relays. It will be electrically powered itself in order to run the logic processor or CPU. It can be expandable and changeable.

Specific Embodiments of the Control System

Figure 3:
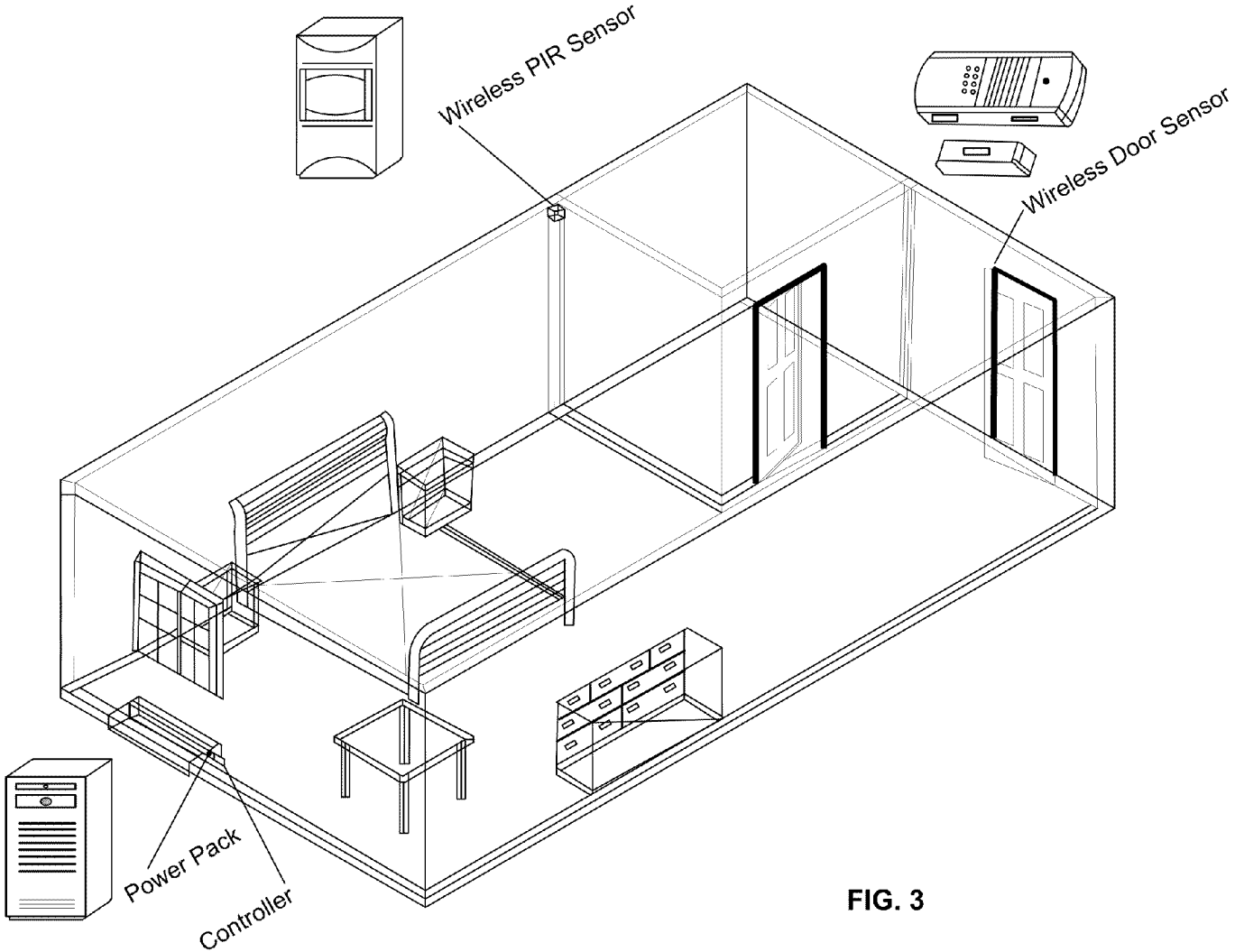
FIG. 3 is a diagrammatic representation depicting one embodiment of an installation of selected components of the present system.
Figure 4:
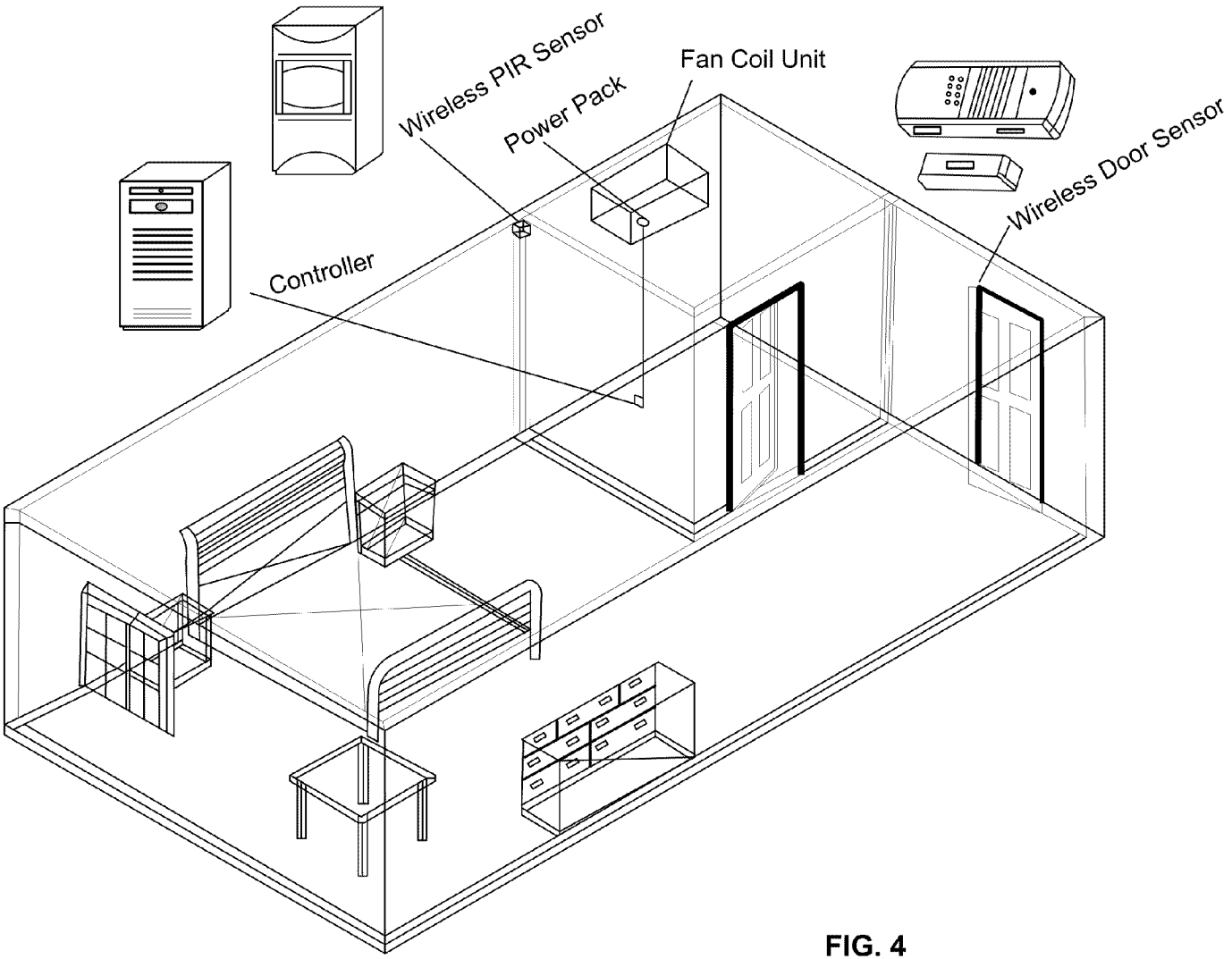
FIG. 4 is a diagrammatic representation depicting one alternative embodiment of an installation of selected components of the present system.

Because the applications and uses of the present control system are so broad, its immediate goals and practical application are important to define. Although it would ideally work in any environment to control any appliance, a particular embodiment will necessarily include a more narrow definition and specific purposes. Because the aim is to reduce electricity consumption, desirable choices of appliances to control would be the ones that consume the most electricity, are the most widely abused by users, and are least efficient in operation. Typically the highest electricity-consuming appliance is the electric motor, and the least efficient is the electric element. Electric elements are traditionally used for two purposes: Lighting and heat. Electric motors are used for many applications, but when narrowed down to which are most abused it would be its application in the climate control or air-conditioning system. Thus, the Heating, Air Conditioning and Ventilation (HVAC) systems in enclosed building spaces are a candidate for embodiments of the present control system. HVAC systems are a desirable application for the present control system because, with the use of the PIR and MR sensors, the occupancy of an enclosed space or room can be accurately determined, and the uses of the HVAC can be controlled in order to maintain comfortable living and operating conditions for people while conserving electricity that would otherwise be wasted. The HVAC system uses several elements, including those mentioned above to operate, and those elements are highly inefficient in their use of electricity. Therefore by limiting their use when human users do not use their affected enclosure space, significant reduction can be made in the amount of wasted electricity usage. The present control system can be effectively utilized in areas such as homes, offices, schools, government buildings and hospitality locations, as depicted in FIGS. 3 and 4.

The system is uniquely effective in the application or private use in multi-family apartment housing because of its wireless, expandable, flexible platform. Because it was previously very difficult to install an energy control system into an occupied residence due to time and privacy constraints there was very little new technology being developed for a seemingly large market. With the platform described herein it becomes uniquely possible to retrofit existing multi-family apartment housing while being occupied by tenants with this energy control system. The system can add multiple sensors to handle the additional living spaces traditionally found in private residencies that include multiple bedroom sleeping quarters and living areas. These types of residencies also commonly have multiple external doors that can be controlled through the use of an expanded platform. The control system is capable of monitoring these seemingly complex layouts with the addition of extra wireless sensors to its expandable platform. By saving energy in residencies the system is capable of catering to the consumer markets as well as the overall greater reduction in energy consumption from retail power customers. This is particularly suited to the objectives of electric utility providers in developing programs for new technologies for their residential customer market. By addressing the specific needs of this market this system aims to alleviate a large demand base for electricity.

Because of the inherent nature of the behavior of guests in a hospitality location it easily becomes the most abused and needed space for control by the present control system. Firstly the largest utility consumption in a hotel or motel is electricity. This is because of the numerous electrical appliances the hotel should use to satisfy its guests and the necessity to keep a comfortable internal environment and temperature. Secondly, the highest electricity-consuming appliance in a hotel is its HVAC system. In many cases, especially in extreme climates it is continually operating. Additionally the guest assumes they have already paid for the space and inherently tries to maximize their comfort above and beyond typical usage. The final important factor is that the space is often unoccupied and is still heated or cooled to the guests desired temperature. All of these factors result in an incredibly inefficient system that wastes a tremendous amount of energy.

Additionally the hotel is a business operation that in order to maintain profitability must increase its sales or decrease its expenses. Because sales are limited by the number of guestrooms its final option to increase profitability is to decrease operating expenses. With the rise in energy costs, because that is the second highest operating expense besides the staffing payroll in a hotel or motel, it becomes the logical choice to seek relief. This can be simply and effectively done by maintaining efficient temperature within the facility and by automating the HVAC use in the room space when the human user (guest) leaves the room. By using the sensors described the present control system can become a very effective tool to help reduce the wasted electricity usage by the hotel or motel and consequently reduce their operating expenses making it a more profitable business. Combined, this makes a very attractive application for the product, however due to the inherent nature of the application the present control system must be specifically adapted to make it feasible in that environment.

In order to be a commercially viable product in the hospitality market there must be several special adaptations to the present control system. This concept has been attempted in the past with various design products however they are all limited in their ability to effectively solve the problem. Because automating the room is also a function of reducing employee workload it is important that the system be self-sustaining and require no interaction from the employees. The present control system must be fully autonomous once installed into the room so that it will not require management to interact with it. In the past systems require the front desk management or maid to interact with the system to tell it when the room has been sold or unsold. Because automation is designed to reduce human error, not increase it, the present control system must act as a stand-alone appliance. Additionally it should operate independently in each room so that if there were to be a system failure it would not affect the entire operation of the hotel or motel property.

Concurrently the present control system must also not rely upon guest interactions because the guest will most likely attempt to circumvent the system or could possibly cause a user error, thus automation provides a benefit. In previous systems the guest must interact with a thermostat or make the system aware of their presence. With the present control system the guest will have zero or no interaction with the system whatsoever. This also means that the system must be able to be mounted or placed in a way that minimizes the guests' knowledge of its installation. It is designed to be small and discreet in design. Very importantly is the fact that the relays are hard wired into the electric appliance source location. If the relay is located within a wall plug the guest can easily circumvent the operation of the relay rendering the system ineffective.

Because the room temperature is important in a hotel guest's satisfaction, the present control system must also have a means to control the temperature while the guest is out of the room. The room temperature must be read by a thermometer or thermistor device that will inform the "Brain" when it is necessary to restore power to the HVAC to maintain the room temperature. There will be pre-selected temperatures at which the present control system will maintain the room temperature when the guest is away. These temperatures will be far enough from the median temperature to affect energy savings, but close enough to maintain a comfortable lever when the guest returns to the unoccupied space.

It is crucial to note that the system used for temperature selection is the "set-back" method. This is the most efficient and effective means of saving energy on a HVAC system based on occupancy. Previous designs for products of this type use various methods such as a progressive temperature rise that gradually increases the difference over time if the room remains unoccupied. Although comforting it is ineffective at achieving the desired savings levels. It is mainly used because of system design flaws in which the system cannot accurately determine if a room is occupied or un-occupied, primarily for a lack of a door sensor. Another alternative means that is not used by the present control systemic a means by simply regulating the on and off time of the electrical appliance or HVAC while the room is unoccupied. In environments where there is a drastic temperature change this can be ineffective in maintaining a comfortable room temperature level.

Although present control systemic regulating the on and off time through temperature selection it is important to note that in effect the present control system will be regulating the temperature or appliances with "on" and "off" cycles. This means the scope of the use of the present control systemic to include itself as a "device that regulates the electricity use of appliances or HVAC by limiting their on and off cycles." Even if this cycle is variable dependant on current climate conditions, user settings, HVAC system specifications, and the like.

The present control system must also be able to have various settings for the hotel management that are set before or after installation depending on their preference. These settings are listed in the Appendix A. All of these factors are designed to specifically cater to the hospitality environment.

Important to the concept of the present system is the use of wireless technology for its sensors to communicate with the central controller unit. Previous attempts at a control system have largely failed in this market because the installation is limited due to the need for hard wiring. The sensors must be mountable on solid construction surfaces such as concrete, and they cannot be unnecessarily difficult to install. By using wireless sensors, the present control system will install quickly and easily so that the room will not have to be taken off of the market during installation, and to reduce the extraordinary costs of labor installation on re-wiring of the rooms. It is ultimately important in properties that cannot be re-wired due to code or historic restrictions.

It is important that the method of wireless transmission be defined. In the past there have been systems that operate with an Infra Red (IR) form of wireless signal communication. The component would communicate its information to the central processor using IR transmissions. This can be very limiting in the installation because the components must maintain a line of sight path with the receiving device. It also restricts the equipment if an object or human user pierces the path of communication rendering the equipment inoperable and ineffective. Because of these considerations, it is clear that the desirable form of communication is through Radio Frequency Transmission (RF). RF communication allows coded messages to be sent through airspace with little restriction as to positioning of the components or the human user location in the room. RF communication has also been used for this type of system in the past, although very ineffectively. The present embodiment of the control system will use a specific type of RF communication to overcome the inherent complexities of operation. In the past, systems attempting to use RF communication have never successfully come to market because of the inherent complexity of operating up to several thousand communication signals in a defined location. Because a hotel or motel property is made up of many rooms, with many sensors, there is a potential for a virtually unlimited number of RF signals to be generated. Previous technology had made it impossible to operate in one area with all of these simultaneous signals, so these products have never fully developed or come to market. The present control system has adapted a specific means of RF signal communication to this restrictive environment, which is a key element to the unique design of the present system and why it is well suited for the specific application of HVAC system control within the hospitality industry.

The present control system has developed a specific protocol and method of transmission for its wireless transmissions that allows it to work in high-density radio traffic areas. This method was developed out of a desire to operate successfully in the hotel/motel environment. Two very significant problems must be overcome in order for RF sensors to be successfully utilized in any hospitality location.

A: Threshold Interference—

In engineering terms the "threshold" is the background noise of radio waves that exists within the atmosphere. This is a variable level based on the amount of radio frequency activity within an area. Any radio-transmitting device can detect this level. For example, an electric motor generates electric noise as it operates, and the noise bleeds into the atmosphere. A cellular phone will transmit a radio signal to its repeater. An Air Force AWACS radar plane used to detect airplanes will emit a powerful signal across hundreds of miles. All of these devices, when combined together, create a specific noise level of background radio frequency activity. In order for a radio-transmitting device to achieve a successful signal (decode) it must be able to pierce this level of activity. It can do so in several ways. The easiest way and most common way in RF engineering is with power. The stronger a signal is, the easier it is to overcome all other signals. Because FCC limitations restrict the ability to increase output power, and power consumption (a wireless device must operate on batteries therefore cannot simply increase the power or it will have no operating lifespan), the present control system will pierce this threshold in a creative way. There are currently two solutions.

The first is called bi-directional transmission in which the wireless transmitter (sensor) and receiver can communicate with each other. This means that the receiver must verify it has received its intended transmission before the transmitter will cease to attempt sending the signal. This is very effective but limiting in the hospitality application for several reasons, but mainly due to power consumption as mentioned above. It would require an unreasonable power source (e.g. large batteries) to achieve a feasible operating lifespan. A further consideration is cost; this solution would drive the cost beyond practicality because the necessary transmitters and receivers are still not widely enough produced to maintain economies of scale.

The second solution is specifically designed for use in the present control system in the application of an automating device with wireless sensors, specifically for the hospitality market. This RF design scheme is to use a mathematically generated algorithm to randomize the transmissions from the transmitter (sensor) to the receiver.

Figure 5:
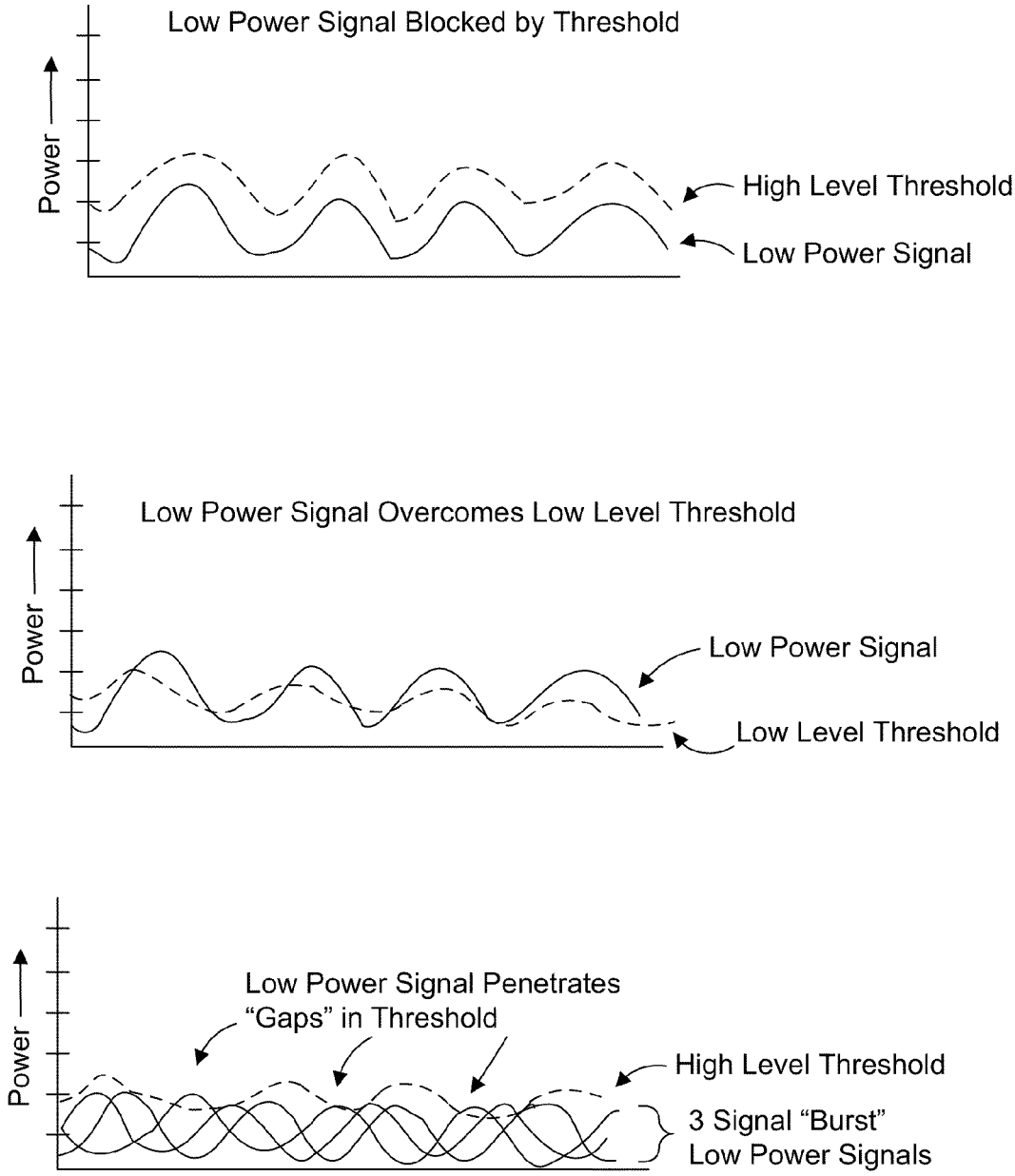
FIG. 5 presents graphic representations of one embodiment of an RF interference avoidance strategy of the present invention.

Since bi-directional transmission cannot realistically be used in this embodiment, it is impossible to guarantee that a single transmission from the sensor component to the receiver will achieve a "decode." There are simply too many external factors, a ship to shore transmission might momentarily flood the airwaves and consequently interrupt hundreds of sensor data transmissions from reaching their intended receivers. This factor makes it desirable to send multiple signals; however again the amount of signals that can be sent is limited due to practical limitations on power supply (battery life). Control systems according to the present invention will use between two and twenty transmission bursts for each signal transmission. As seen in FIG. 5, because there are inherent "gaps" in radio transmissions within the threshold (i.e. a continually transmitting ship to shore radio of immense power will have micro second lapses in transmission power), and over time, the threshold level will vary. It then becomes possible to "squeeze through" these minute gaps even with a much lower-powered signal. By repeating the transmission several times, the probability that a signal will achieve a successful transmission and subsequent decode is greatly increased. To further increase the probabilities, a mathematical algorithm is applied to "randomize" the signal spacing. The present controller and receiver are programmed to accept varying signals from the transmitter (sensor), e.g., the receiver can accept different lengths of signals. That means that every time a sensor bursts between two and twenty transmissions, it can randomize the signal length and gaps that are sent. This will exponentially increase the probability that the signal will "sneak" though the threshold of RF interference. With this method of RF transmission, success in surmounting the first obstacle of low power radio transmission necessary for this application of the present control system can readily be achieved.

B: Cross Communication of Multiple Component Signals—

The second obstacle in applying RF communication technology to the hospitality application of the present control system is the cross-contamination of signals by the system's own components or those of neighboring components. This factor has also kept systems attempting to use RF technology from being successfully marketed for this application.

Traditionally with RF technology the easiest way to overcome cross-contamination of signals is by operating each separate signal on a slightly different frequency band. By employing this technique, it would not be possible for one signal to interfere with another, assuming they were all transmitted at a similar power level. Unfortunately this solution is also not feasible for the hospitality industry. Because there are potentially hundreds of transmitters operating simultaneously, this technique would require hundreds of various frequencies. This is not practical in the manufacturing and certification process for such a system because it would increase the cost of the system beyond a reasonable level. It also has other limitations, in that each frequency would have to be cataloged and organized in the installation process to avoid installing two components of the same frequency within near proximity. This requirement adds a significant burden to the installation and would limit the installation flexibility, especially in the level higher of skill required by an installing party.

The second technology typically used when operating multiple transmitters on similar frequencies is known as "code-hopping." This means that each individual signal is sent with a different randomly-generated transmission code. By increasing the number of variables such as the code, the likelihood that two identical codes will be transmitted to the same receiver is reduced significantly. The present control system uses a publicly available protocol or variant of this called "Manchester" code. This is not however a "true" form of code-hopping. Again because of cost and technology restraints, the present control system has included a means for code selection when used in this application.

Located within the processing chip of the transmitters (sensors) there is a software-programmed, mathematically-generated algorithm that draws from a bank of roughly 4 Billion various patterns of transmission "burst." Because the individual components must be assigned or "learned in" to each receiver during the installation, the opportunity to designate a specific and randomly generated code for each component is utilized. This code is randomly selected the first time that component is "learned in" to its coinciding receiver. The receiver will then recognize this code and only that code for that component. Because the number of codes is very high, the probability that two components within near proximity will chose the same code is very low. By doing this it eliminates the necessity to choose a frequency or protocol manually with each component (such as the "dip switch" that is commonly used on a garage door opener or alarm sensor). The present control system is the only such RF system that will generate a random code upon initial component designation to its assigned receiver. By doing so, the chance that two components signals will interfere is reduced substantially.

It is the combination of these two schemes for RF transmission in this embodiment that makes it realistic to operate a wireless RF component in this or any application for energy savings and appliance automation based on occupancy.

C: Ability to Operate Multiple Components with a Single Receiver

The present control system is the only system of its kind that can operate multiple sensors using one receiver. It is expandable to operate from the minimum of one PIR and one MR. The current configuration is to hold in memory up to 3 PIR and 3 MT sensors however this can be expanded further. Each sensor is uniquely "learned in" to the receiver upon installation. Each component is recognized and learned in separately and has a unique identifying "LED" light to make the operator aware of its function status. The present control system is the only system of its kind that can "learn in" multiple RF transmitting components so to adapt to various applications.

D. Ability to Operate Under Low Voltage with a Short Antenna

It is important in the design of the RF hardware used in the present control system sensors (transmitters) and receiver that it can operate using low voltage with a reasonable antenna. The present control system is the only product of its kind to operate wirelessly with RF with an internal antenna that does not protrude beyond its normal housing. Many previous attempts for products of this kind to operate wirelessly have included antennas up to 10' in length, which poses numerous problems on use and installation. It is specifically detailed that present control systemic the first product of its type and application to use internal antennas.

E. Ability to "Default" with Loss of Communication

If for any reason the present control systemic to lose communications with one of its components, the present system will automatically return to a "default" mode where it will deactivate and lock the relay into an electric flowing position. This will prevent any non-operation of controlled equipment in the event the receiver does not receive a transmission. It is desirable to have this feature since with other devices of this kind if there is a loss of signal it is also possible to lose operation from the HVAC or other equipment being controlled.

Although there are many considerations into the specific design of the present control system for use in its application of the hospitality market, many of these are directly related not to the operation method of the product but rather the installation. Because installation is a significant cost factor it is important to limit the necessary knowledge, skill and tools necessary to perform the installation. It is a unique and primary goal of the present control system to have its installation performed by the operator. There is currently no system of this type that is actively marketed to have the operators perform their own installations. This is a major obstacle in obtaining a product that is widely marketed because of the diverse locations and logistical problems with organizing an installation team to travel to various hotel installation locations. By eliminating the need of a dedicated installation crew for this product it becomes realistic to market it in a much wider fashion.

The key elements to the installation of the present control systemic its unique methods:

A: Wireless RF—

The components (sensors) can be easily placed within the room enclosure. There is no special knowledge or expertise required in locating the components. Previous cumbersome RF based systems of this kind required low frequency components and radio triangulation to achieve an effective signal decode. The present control system requires no triangulation or specific knowledge of radio waves or radio engineering.

Unlike IR systems of its kind there is no need to install around obstacles or have limited component placements.

Unlike hard-wired systems of its kind there is no need to complete room re-wiring or have a labor force with special knowledge of construction or contracting to manipulate electrical supply or wall fishing of electric wire. Because there is no wiring, it is possible to install in historically designated buildings that prevent hard-wiring or electrical re-wiring by code, as well as concrete block construction that limits wall access.

Additionally the internal antenna is important to the practical installation of the present system. With a large external antenna it becomes difficult to mount the antenna and would possibly require wall intrusion, which is not possible in certain constructions. It is noted that in previous cases for products of this type and application, the antenna can even be destroyed by housekeeping appliances, such as vacuum cleaners, making the installation position important.

B: Programming—

Because all of the unit's settings (see Appendix A) are simply made through changing a "jumper" position, it is not necessary to use a laptop, palm pilot or other programming device to change the settings. The installer does not need special computer training or knowledge to adjust the settings or installation parameters. Because there is no central computer system the present control system will not require extensive professional knowledge specific to the system to install it.

C: Wireless Component Learn In—

Unlike previous attempts at using wireless RF and IR components for a system of this type and application, the present control system uses a very simple method of component assigning. No special tools or professional knowledge is required to assign the components. A simple process whereby the intended component "position" is highlighted with a button and this is indicated with a red "LED" light. The component itself has a "learn" button that is depressed to generate the random code it will use and transmit this to the Brain (receiver). Once the receiver detects the presence of this component it is locked in and the installer has completed his task, which is indicated by a solidly lit red LED light. This is a unique scheme used by the present control system to ease the installation. The Installer does not have to keep track of individual component identities of frequencies.

D: Wiring:

The wiring of the present control system relay is minimized and requires less than 4 wires. Unlike other systems it includes a quick release system to rapidly remove the wiring so that HVAC units can be quickly and easily serviced. This operation does not require any special skills or professional supervision. The control system can concurrently be wired through existing low voltage thermostatic control so as not to require any additional relays or transformers when the sole objective is to control the HVAC system. This is particularly useful when installing the system into multi-family apartment residencies or other areas where there is generally some type of user-interface thermostat control of room temperature, be it mechanical or digital.

These factors all combine to allow the average, untrained, non-professional maintenance personnel or user to complete the entire installation of the present control system rapidly and effectively. This unique feature allows the present control system to become much more effective to its intended user, reduces overall initial costs, and eliminates the need for complicated installation crew logistics. This is not realistic with any other system of this type or application.

One of the important factors in the successful marketing and implication of a product of this kind will be its total cost to install and operate the product. Because in large part the decision of the user to make an investment for a product of this type will be based on its overall energy saving capabilities and more importantly its return on investment (ROI) period. Energy savings devices of this type are mostly limited to a similar level of energy savings. This is variable from condition, application and ultimately the behavior of its users however there is a finite range of savings available from zero or none in which the appliance user never leaves the approximate space, to around fifty percent in which the spaces and appliances economy are maximized through the regulation of occupancy. Because this savings is finite, the ROI period is only variable by the total cost of installation on the product. This is affected by the manufacturing costs and level of technology involved in the device's construction as well as its design and the total cost of installing this design type. The present control system has maximized all of these cost-basing factors through its design so that the end user will achieve the shortest possible ROI period. The present control systemic the only system of its kind or application that utilizes the level of skill required by the installer as a limiting factor in cost.

Although the current configuration of the present control systemic designed to maximize its ability to perform in the specific environment of the Hospitality Hotel/Motel market, it is capable to be adapted to a wide variety of uses. The technology used to make it effective in the hotel market can also be applied to make it effective in other similar environments such as office spaces, apartment housing, and school classrooms, all of which are high density environments and may require special use of the present control system for RF component transmission and efficient installation techniques.

Appendix "A" is a summary of the various design features of the present control system and its customized individual settings that are available in its current version. Each of these is unique to the present control system. It is all of these factors that make the present control system uniquely suited for applications specifically within high-density areas but no limited to, and in all aspect of appliance control for the application of energy savings.

All patents and patent applications cited in this specification are hereby incorporated by reference as if they had been specifically and individually indicated to be incorporated by reference.

Although the foregoing invention has been described in some detail by way of illustration and example for purposes of clarity and understanding, it will be apparent to those of ordinary skill in the art in light of the disclosure that certain changes and modifications may be made thereto without departing from the spirit or scope of the appended claims.

APPENDIX A

Features of the present control system

Figure 2:
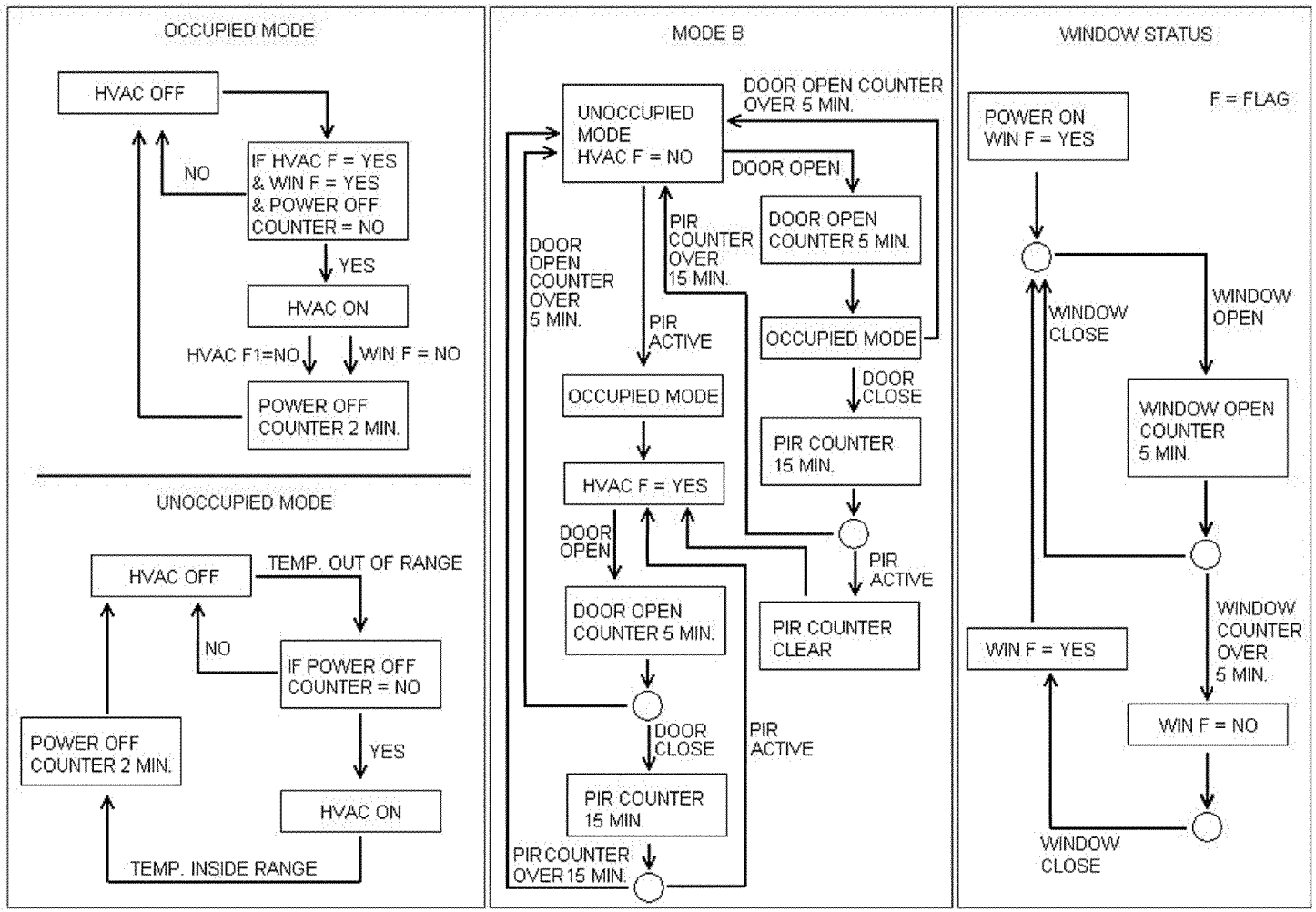
FIG. 2 is a block diagram depicting one alternative embodiment of a mode of operation of the present system.

| Feature | Benefit |
|---|---|
| Mode A | This feature, as shown in FIG. 1, is designed for the discerning hotel operator with maximum guest HVAC control and comfort in mind. During Mode A operation the guest maintains full control of the HVAC. In resort properties occupying guests often like to operate the HVAC with the front door open and or the balcony doors/windows open for unlimited periods of time. With Mode A the occupant will never be disturbed by the control system, even while leaving the doors/windows wide open. |
| Mode B | Mode B, as shown in FIG. 2, was designed for hotel operators who aim to minimize electricity expense and strenuous HVAC operation. This mode allows for the maximum balance of guest comfort and energy savings, by letting guests have full control of HVAC operation with one exception. When the front door or balcony door/window is open for more than five minutes, the HVAC simply shuts off until doors/windows are closed. There were several considerations in designing this feature, including:<br>A. The front door can be left open for five minutes without the control system taking control in order to allow guests to get ice, deliver luggage, or to leave the room for short periods of time with the front door open.<br>B. Running the HVAC with the doors/windows open creates the most strain a system can handle. By preventing this, HVAC lifespan will increase dramatically, as well as reducing heavy demand loads.<br>C. Resort properties often contain sliding doors/windows in which this feature is highly valuable, and often requested by hotel property operators.<br>D. This feature is not available on systems that do not use a main door sensor, or have the capability to add additional sensors for balconies and windows! |
| Adjustable timers for Occupancy Search | To determine unoccupied mode, the control system will search the guestroom for a specified period of time (5/10/15 minutes) before the HVAC is taken over by the Brain unit and temperature is set to an energy-optimizing level. These adjustable timers allow the hotel management to determine how long the control system will spend detecting room occupants. The shorter settings are used for maximum energy savings, while the longer settings (15 minutes) allow for maximum guest comfort. |
| Adjustable Temperature Setbacks | Preset control system temperature setbacks provide minimum and maximum energy economizing temperatures to be set by hotel management that controls the unoccupied guestroom temperature.<br>By setting back the temperature as little as 10 degrees; you can achieve a savings of around 30% without compromising the guest comfort. These two settings will satisfy both winter and summer environment requirements for an unoccupied guestroom. Temperature setback ranges are in 5-degree increments between 50 and 90 degrees Fahrenheit.<br>The temperature setback is further settable or can be calibrated more finitely in increments of 1 degree Celsius by entering a special "calibration mode." |
| ON and OFF Selector | This feature was designed to give hotel/motel management full control over room temperature setback.<br>A. The "ON" setting in which the control system temperature setback functions are enabled while the room is vacant or unoccupied. This means that only when a guestroom becomes unoccupied, the control system will maintain the room temperature within the management pre-selected adjustable temperature setbacks. This allows for maximum guest comfort.<br>B. The "OFF" setting was designed for the hotel operator who is less concerned with guest comfort and more concerned with energy savings. In the "OFF" setting the control system does not regulate room temperature but simply turns off the appliances being controlled. This means that the control system will cease current to the appliance or HVAC being controlled only while the room is vacant or unoccupied. This setting will also allow the room temperature to float to its own equilibrium while the room is unoccupied, allowing for maximum energy savings. It is also particularly useful when controlling appliances other than HVAC such as lighting so that they do not power cycle during unoccupied periods when a setback temperature limit is reached and the unit attempts to control the room temperature, such as in the "ON" setting described above. |
| Main Door Sensor | This component communicates using radio frequency and is important in determining occupied vs. unoccupied status in a guestroom. Through experience it has been found valuable to have a main door sensor to maximize guest comfort. It also allows the system to operate with other features such as the "Mode B" (see section Mode B), which is not available in systems that do not feature a main door sensor. The second a guest leaves the room the main door sensor communicates to the Brain unit that someone has left the room; this starts the adjustable timer for occupancy search. By using timers in conjunction with the wireless door sensor this greatly increases the accuracy of determining room occupancy. This is useful for maximum guest comfort AND energy savings. |
| Passive Infrared Sensor | The PIR also communicates with the Brain unit using radio frequency and is used to cross reference the occupancy status of the guestroom with the main door sensor. To insure without a doubt that the room is unoccupied (unlike lower grade motion sensors) the PIR scans the room with a tri-spectrum 3-D passive infrared beam detecting both motion and body heat.<br>In the event that the PIR sensor detects an occupant within the room, the present control system will |

APPENDIX A-continued

Features of the present control system

| Feature | Benefit |
|---|---|
| | automatically revert full control of the HVAC to the guest. This prevents problems often found with other energy management systems (EMS) such as with sleeping guests, or multiple guests staying in one room. |
| Additional Door/Window Sensors | This feature was added due to the many requests by resort hotel operators who wish to control the HVAC system while their guests leave the balcony doors/windows open unnecessarily. Additional door sensors can be added/programmed into each present control systemic the case of multiple bedrooms or balcony doors/windows that need to be monitored for HVAC operation. The present control system can program up to three (3) additional wireless door/window Sensors, unlike some systems that only allow for one. This feature also allows for special applications requiring more than one entry door or multiple external doors such as multi-family type apartment residencies or beachfront hospitality locations. |
| Additional PIR Sensors | Each present control system Brain can be programmed to work with a maximum of three (3) PIR(s). This feature was designed for hotel properties with multi-room suites. Because the PIR sensor(s) are wireless this eliminates the construction that can often eliminate hard-wired energy management systems (EMS) from installing in large suites or multi-room guestrooms or multi-family apartment residencies. |
| 2-Minute Cycling Time | This is a management selected setting within the Brain and was designed for use in hotels that utilize PTAC type HVAC systems. This option is used in order to help save the compressor lifespan of PTAC (and various other HVAC units) by utilizing a 2-minute delay for the compressor to completely cycle. If used this cycling will occur any time the HVAC unit is turned off (i.e. when the present control system goes into unoccupied mode.) |
| Auto/Manual Toggle for Brain Unit | This is a hidden switch on the Brain unit that allows the management to shut the present control system on or off for any reason. If switched to "manual mode" it simply allows the guestroom HVAC to operate as if the present control system were not there. This was designed for the hotel operator's ease of mind. On many other energy management systems (EMS) there is no way to disable the unit without disconnecting the system and possibly disrupting HVAC operation, or even worse guestroom availability. |

The invention claimed is:

1. A control system for controlling a Heating, Ventilation, and Air Conditioning (HVAC) unit associated with an enclosure, the control system being configured to control the environmental conditions within the enclosure by controlling the operation of the HVAC, the control system comprising:

an occupancy sensor for sensing the presence of an occupant within the sensor's field of evaluation in the enclosure and providing such information to a receiver;

an activity sensor capable of sensing a change in status of a means of access to said enclosure and providing such information to a receiver;

a receiver configured for the reception of information from said occupancy sensor and said activity sensor; and at least one controller in communication with said receiver, said controller capable of monitoring environmental conditions in the enclosure and being programmable to control the environmental conditions by driving the HVAC according to a set of established instructions in response to the information obtained by said receiver from both said occupancy sensor and said activity sensor;

wherein information received from the activity sensor is configured to initiate a time period during which the occupancy sensor is configured to search the enclosure for an occupant, and wherein the controller is configured to take control of the HVAC operation after expiration of the time period when the occupancy does not detect the occupant during the time period.

2. The control system of claim 1, wherein the controller is further configured not to take control of the HVAC when the occupancy sensor does detect the occupant during the time period.

3. The control system of claim 1, wherein the controller is configured to take control of the HVAC operation by shutting the HVAC off.

4. The control system of claim 1, further comprising a manual HVAC control configured to allow the occupant to control the HVAC so as to maintain a set temperature, and wherein the controller is configured to control the HVAC operation according to a set of temperature thresholds when the occupancy sensor indicates that the enclosure is unoccupied.

5. The control system of claim 4, wherein the controller is further configured to control the operation of the HVAC by turning it on or off when the thresholds are reached or exceeded.

6. The control system of claim 4, wherein the controller is further configured to control the operation of the HVAC by turning it on or off for a certain period of time when the thresholds are reached or exceeded.

7. The control system of claim 6, wherein the certain period of time can be based at least in part on the environmental conditions.

8. The control system of claim 4, wherein at least some of the temperature thresholds are user settings that can be altered by the user.

9. The control system of claim 1, further comprising a manual HVAC control configured to allow the occupant to control the HVAC so as to maintain a set temperature, and wherein the controller is configured to turn the HVAC off when the activity sensor indicates that the status of the means of access has changed, when the occupancy sensor indicates that the enclosure is unoccupied, or both.

10. The control system of claim 1, wherein the controller is configured to take control of the HVAC operation after the expiration of a second time period.

11. The control system of claim 1, wherein the controller is further configured to maintain control of the operation of the HVAC until the activity sensor senses that the occupant has returned to the enclosure.

12. The control system of claim 1, further comprising a plurality of activity sensors configured to detect when the occupant enter or exits the enclosure through a main entrance as well as when the occupant opens a window, balcony door, or other secondary entrance, and wherein the controller is configured to take control of the operation of the HVAC when one of the plurality of sensors detects that a window, balcony door, or secondary entrance has been opened.

13. The control system of claim 1, wherein detection that a window, balcony door, or secondary entrance has been opened initiates a third time period, and wherein the controller is configured to take control of the HVAC operation upon expiration of the third time period.

14. The control system of claim 1, further comprising a manual HVAC control configured to allow the occupant to control the HVAC so as to maintain a set temperature, and wherein the controller is configured to control the HVAC operation using on and off cycles and temperature thresholds that relate to the set temperature.

15. The control system of claim 1, wherein each of the occupancy sensor and activity sensor are configured to wirelessly transmit their respective information to the receiver using a mathematically randomized transmission pattern.

* * * * *